United States Patent [19]

Simmons

[11] 3,934,636

[45] Jan. 27, 1976

[54] SHOWER CURTAIN HOLDER

[76] Inventor: Jimmy W. Simmons, 2400 Haworth, Apt. 13, Newberg, Oreg. 97132

[22] Filed: Sept. 20, 1974

[21] Appl. No.: 507,598

[52] U.S. Cl. ..... 160/349 R; 4/149; 24/72.5; 292/147

[51] Int. Cl.[2] ..... A47H 1/00

[58] Field of Search ..... 160/349; 4/149, 154; 292/147, 145; 24/72.5, 263 SB, 263 FC, 265 B

[56] References Cited

UNITED STATES PATENTS 1,758,263 5/1930 Merz ..... 292/147

*Primary Examiner*—Philip C. Kannan

*Attorney, Agent, or Firm*—Eugene M. Eckelman

[57] ABSTRACT

The holder has a body portion arranged to be secured to a wall immediately above the vertical flange of a bathtub. A slide member is slidably supported in the holder and is arranged to project from the lower end of the body portion to clamp a shower curtain down on the flange of the bathtub. The slide member has frictional movement in the body portion for positioning it between the lowered shower curtain engaging position and an upper release position and includes an aperture therein forming a finger grip for moving it between the two positions.

4 Claims, 5 Drawing Figures

SHOWER CURTAIN HOLDER

BACKGROUND OF THE INVENTION

This invention relates to new and useful improvements in shower curtain holders.

In the usual bathtub and shower combination, curtains are often provided along the outer side of the tube. Water usually escapes from a space between the front edge of the shower curtain and the wall since it is difficult to hold such front edge close to the wall. This is due to the ring support of the curtains at the top and also due to billowing movement of the lower portion of the curtain because of the rising heated air.

Some attempts have been made to hold the curtain in a fixed position, such as by using a plurality of clip members or the like secured to the wall and arranged to be connected to the shower curtain. Such a structure is shown in U.S. Pat. No. 2,303,502. This structure, although effective in holding the curtain in place, is inconvenient in its use in that each time a person wishes to shower, all the clips must be fastened and unfastened. This type of structure and others intended for the same purpose are not only inconvenient to use but are expensive to manufacture.

SUMMARY OF THE INVENTION

According to the present invention and forming a primary objective thereof, a shower curtain holder is provided which is effective to hold the curtain close to the front wall of the shower and at the same time is convenient in its use and economical to manufacture.

A more particular object of the invention is to provide a holder of the type described comprising a body portion adapted to be secured to the wall adjacent to the front outer corner of the bathtub and employing a friction slide therein arranged to project from the bottom and clamp the shower curtain down on the flange of the bathtub.

The invention will be better understood and additional objects and advantages will become apparent from the following description taken in connection with the accompanying drawings which illustrate preferred forms of the device.

DETAILED DESCRIPTION OF PREFERRED EMBODIMENTS

Figure 1:
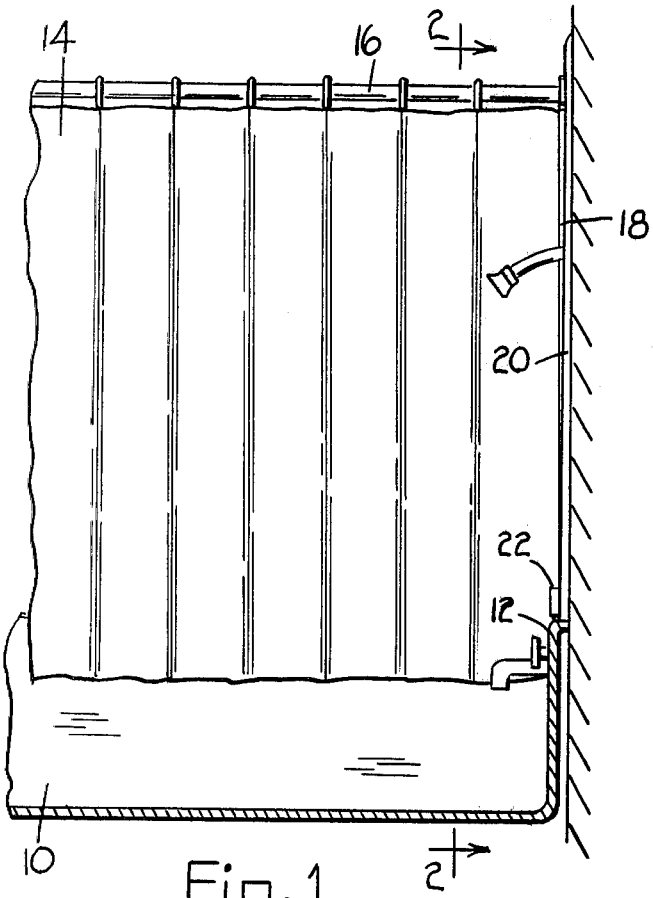
FIG. 1 is a fragmentary sectional view taken longitudinally through a bathtub and shower and illustrating the present invention in combination therewith.
Figure 2:
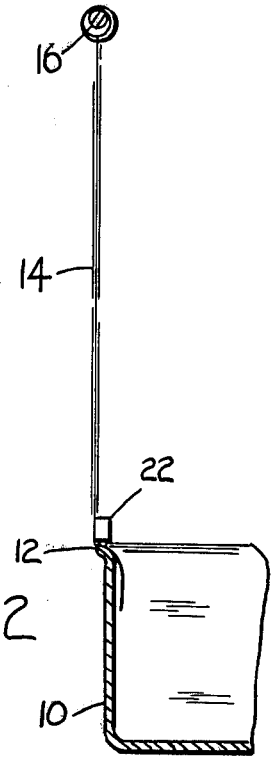
FIG. 2 is a fragmentary sectional view taken on the line 2—2 of FIG. 1.

Referring first to FIGS. 1 and 2, the numeral 10 designates a conventional bathtub having the usual top horizontal flange 12. The numeral 14 represents a shower curtain supported slidably on an upper rod 16. The lower end of the curtain hangs down a short distance into the tube to prevent splashing of water on the floor. In conventional practice, the bathtub 10 is mounted in association with a front wall 20 to receive plumbing structure.

Figure 3:
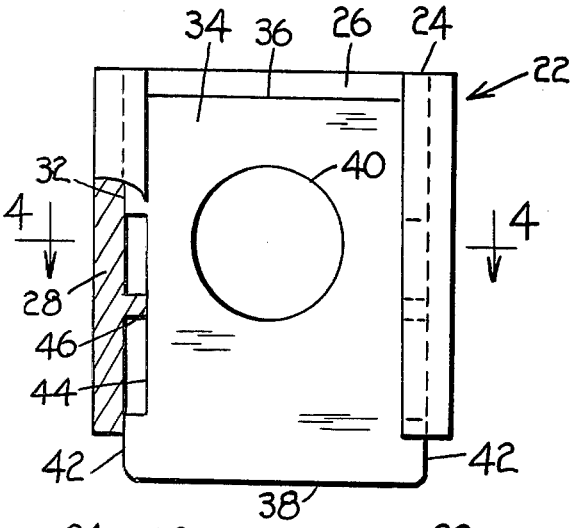
FIG. 3 is a front elevational view, partly broken away, of the holder of the present invention.
Figure 4:
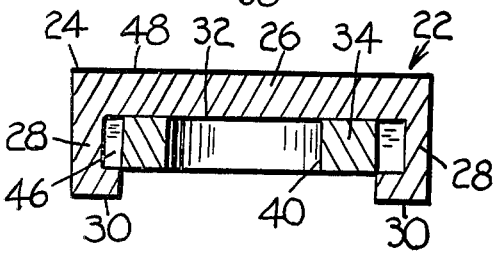
FIG. 4 is a sectional view taken on the line 4—4 of FIG. 3.

The present invention holds the front edge 18 of the shower curtain closely adjacent to the wall 20, particularly in the area of flange 12 of the tub and a distance thereabove. The holder is designated generally by the numeral 22 and has a body portion 24 which as best seen in FIGS. 3 and 4 includes a rear wall 26 and side walls 28 in a U-shape. Inturned wall portions or tabs 30 lead partially across the front and form a vertical guideway 32 within the holder.

Slidable in guideway 32 is a slide member 34 having upper and lower ends 36 and 38, respectively, and also having an aperture 40 intermediate its upper and lower ends which forms a finger grip. Slide member 34 is arranged for vertical movement in the guideway 32, and the side edges 42 thereof have frictional engagement with the inner surfaces of the side walls 28 so that the slide, although adjustable vertically, will remain where positioned.

The side edges 42 of the slide member 34 have notches 44 and walls 28 have inwardly directed stop projections 46 in an arrangement such that the slide member 34 can have vertical adjustable movement but has limited upward movement so that it cannot be displaced from the holder. In its downward position of the slide member a lower portion thereof can project from the bottom of the body portion as seen in FIG. 3. For purposes of assembly, the body portion 24 is constructed of a somewhat flexible material such as polyethylene plastic, and to install the slide member 34 the sides of the body portion are merely flexed apart an amount sufficient to install the slide member.

With particular reference again to FIGS. 1 and 2 the holder 22 is shown in position for holding the curtain close to the front wall 20 so that water cannot escape between the front edge 18 of the shower curtain and the wall. For this purpose, the holder is secured to the wall just above the tub at the front outer corner thereof. Securement to the wall may be by any suitable means, such as by an adhesive backing 48, FIG. 4, provided on the body portion. It is to be understood however that other securing means may be utilized to mount the holder on the wall, such as by suction cups or the like.

Positioning of the holder on the wall relative to the tube is such that the bottom end 38 of the slide member 34 in a lowered position of the latter is capable of engaging the top of the tub flange 12, as shown in FIGS. 1 and 2. In the use of the holder by the person taking a shower, the shower curtain is pulled forward with the edge 18 against the wall and a forward portion of the curtain at the level of tub flange 12 is then placed under body portion 24, the slide member 34 being disposed in a raised position at this time. With the curtain held in a forwardmost position under the holder 22, the slide member 34 is then lowered to clamp the curtain against the tube flange. The front edge of the curtain below the holder will curve around the inner surface of the flange of the tube and drape down in the tub.

With the curtain held close up against the wall water will not splash out of the shower. Although the curtain is not positively held against the wall in upper portions of the shower, the close association of the front edge at the tub by the holder 22 causes upper edge portions to hug closely to the wall. To release the holder, the slide member 34 is moved upwardly out of clamping position with the curtain on the tub, whereupon the curtain can be opened. Movement of the slide member is readily accomplished by engagement of a finger in aperture 40.

Figure 5:
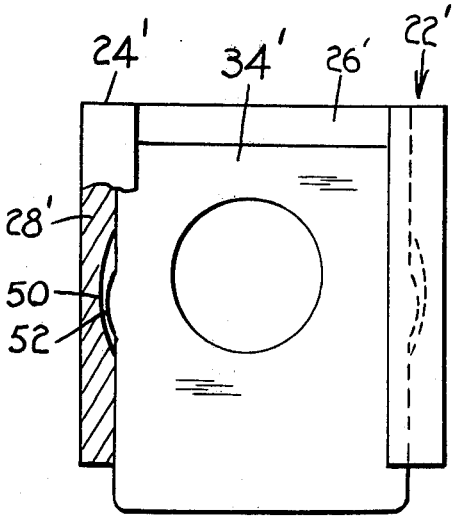
FIG. 5 is a front elevational view, partly broken away, of a modification of the invention.

FIG. 5 illustrates a modified form 22' of the invention, and similar to the first embodiment this modification includes a U-shaped body portion 24' and a slide member 34'. In this embodiment, the side walls 28' have recesses 50 on their inner surfaces and the slide member 34' has outward projections 52 in an arrangement allowing a short vertical movement of the slide member as in the structure of FIG. 3 but at the same time forming a stop so that the slide member 34' cannot be displaced from the holder.

It is apparent that the present holder is effective in holding a shower curtain in relation to a bathtub and wall to prevent water from splashing out of the shower stall and at the same time the structure thereof is simplified and economical to manufacture. The holder is also easily mounted in place by the householder.

It is to be understood that the forms of my invention herein shown and described are to be taken as preferred examples of the same and that other changes in the shape, size and arrangement of parts may be resorted to without departing from the spirit of my invention, or the scope of the subjoined claims.

Having thus described my invention, I claim:

1. In a shower of the type having a bathtub with a top peripheral flange and also having a flexible shower curtain on one side and a wall surface on another side against which it is desired that an end of the shower curtain have close association to prevent water from the shower splashing on the floor, the improvement compressing a shower curtain holder comprising:

a. a body portion having a vertical guideway open at the bottom, b. means arranged to mount said body portion on a wall surface above the bathtub flange, c. and a slide member disposed in said guideway having a lower end arranged to project beyond the open bottom of said vertical guideway, d. said slide member having movement in said guideway between a pair of set positions, e. one of said set positions comprising a lowered position arranged to clamp a portion of the shower curtain which has been inserted under the holder down on the bathtub flange to hold the curtain close to the wall surface and the other of said set positions comprising an upper position for releasing the shower curtain.

2. The shower curtain holder of claim 1 wherein said slide member has frictional engagement in said guideway for holding it in its two set positions.

3. The shower curtain holder of claim 1 including stop means in said body portion engageable by said slide member limiting movement to its upper position.

4. The shower curtain holder of claim 1 wherein said body portion has a rear wall and side walls in a U-shape and including tabs on said side walls directed partially across the front to form said vertical guideway, and means defining an aperture in said slide forming a finger grip in said slide accessible between said tabs for moving the slide between its two positions.

* * * * *